United States Patent [19]

Roth

[11] Patent Number: 4,989,006

[45] Date of Patent: Jan. 29, 1991

[54] MICROWAVE ABSORPTION SYSTEM

[75] Inventor: John R. Roth, Knoxville, Tenn.

[73] Assignee: The United States of America as represented by the Secretary of the Air Force, Washington, D.C.

[21] Appl. No.: 425,141

[22] Filed: Oct. 17, 1989

[51] Int. Cl.[5] ..... H01Q 17/00

[52] U.S. Cl. ..... 342/1; 342/2

[58] Field of Search ..... 342/1, 2

[56] References Cited

U.S. PATENT DOCUMENTS

| | | | |
|---|---|---|---|
| 3,127,608 | 3/1964 | Eldredge | 343/18 |
| 3,713,157 | 1/1973 | August | 343/18 |
| 3,773,684 | 11/1973 | Marks | 252/309 |
| 4,030,098 | 6/1977 | Roth . | |
| 4,791,419 | 12/1988 | Eubanks | 342/1 |

OTHER PUBLICATIONS

L. Jiang et al, "Experimental Results of Microwave Absorption with Varying Magnetic Field in A Modified Penning Discharge", Presented at the Thirtieth Annual Meeting of the APS Division of Plasma Physics, Hollywood, Fla., Oct. 31-Nov. 4, 1988, APS Bulletin, vol. 33, No. 9, p. 1900 (1988).

*Primary Examiner*—Nelson Moskowitz
*Assistant Examiner*—Mark Hellner
*Attorney, Agent, or Firm*—William G. Auton; Donald J. Singer

[57] ABSTRACT

Microwave absorption in a varying magnetic field is investigated near electron cyclotron resonance with a network analyzer which is capable of swept frequency measurements, and of measuring reflection and transmission coefficients from 0.045 to 18 GHz, with greater than 80 dB dynamic range. The experimental conditions are such that the plasma is generated in a modified Penning discharge in a magnetic mirror configuration. A microwave beam is caused to propagate along the axis of the magnetic mirror field in the plasma column. The microwave beam is attenuated near the electron cyclotron resonance frequency, providing microwave absorption over a range of frequencies spanning the electron cyclotron frequencies present in the axially varying magnetic field. The attenuation, along with hot-plasma effects, are measured as a function of frequency by the network analyzer.

14 Claims, 7 Drawing Sheets

MICROWAVE ABSORPTION SYSTEM

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to aircraft protection and antidetection systems and more specifically the invention pertains to a plasma cloaking device which provides microwave absorption using a varying magnetic field.

Traditional aircraft antidetection systems are divided into two broad categories: active systems (which generate radar jamming signals); and passive systems, which rely on some characteristics of the vehicle to reduce the radar return. When the radar jamming transmitter is located on the target aircraft, the jamming signal transmitted by the aircraft can sometimes act as a beacon to the radar tracking system. Passive systems, which include the use of radar absorbing materials on the vehicle's surface, are limited in their ability to reduce the vehicle's radar cross section.

The task of providing a microwave absorption system which can reduce the detectability of satellites and aircraft, and which can protect targets from directed energy weapons is alleviated, to some extent, by the systems disclosed by the following U.S. Patents, the disclosures of which are incorporated herein by reference:

U.S. Pat. No. 3,127,608, A. L. Eldridge, Object Camouflage Method and Apparatus;

U.S. Pat. No. 3,713,157, Henry August, Energy Absorption by a Radioisotope Produced Plasma;

U.S. Pat. No. 3,773,684, Alvin M. Marks, Dipolar Electro-Optic Compositions and Method of Preparation; and U.S. Pat. No. 4,791,419, Gary R. Eubanks, Microwave Absorbing Means.

The August patent, Energy Absorption by a Radioisotope Produce Plasma, which describes a means of attenuating electromagnetic radiation passing through an ionized gas plasma adjacent to a body, teaches placing a radioisotope material on a surface of the body in contact with the gaseous medium surrounding the object. Such radioisotope material ejects energetic particles and quanta into the medium and causes ionization of the gas, forming an ionized gas plasma sheath around the object. This plasma sheath would absorb any electromagnetic energy entering it or would so distort any incoming signal that it would be unrecognized as a radar signal upon its return to its source. This patent also suggests superimposing a DC magnetic field upon the plasma in order to enhance attenuation.

The plasma around the object is constantly replaced by the continuous release of energetic particles and quanta into the gaseous medium surrounding the object. Additionally, this patent predicts a decrease in the plasma density as the distance from the object increases, providing impedance matching and a resulting decrease in the reflectivity of the plasma sheath.

The Eldridge Patent, Object Camouflage and Apparatus, teaches rendering an object invisible to radar by use of an ionized gas cloud surrounding the object. A particle accelerator is used to continuously ionize the gas immediately in front of the object and the object's forward progress through the ionized gas cloud provides the necessary coverage of the object. This patent teaches that the ionized gas cloud will attenuate and refract any incident electromagnetic waves, which effectively makes the object invisible to radar.

The Marks Patent, Dipolar Electro-optic Compositions and Method of Preparation, teaches using a suspension of dipolar particles as a light-controlling means. The particles are in suspension and are oriented by the application of an external electric or magnetic field. This patent teaches a method for creating such a device in which the particles are evenly distributed throughout the suspension, have a fast orientation response upon application of the appropriate exterior field, and are sufficiently transparent or reflective to electromagnetic radiation, depending upon orientation, to allow use of the device as a practical light-controlling device.

The Eubanks Patent, Microwave Absorbing Means, defines a device which is designed to absorb the microwave radiation used in traffic control radar by using a microwave antenna connected to a microwave absorbing means. This patent teaches winding a wire around a fluorescent light bulb as a helical microwave antenna. Each end of the antenna is then electrically coupled to the absorbing tube (fluorescent light bulb) so that the microwave radiation received by the antenna is transmitted to the absorbing tube where it is then absorbed by the gas contained within the tube.

While the above-cited references are instructive, they do not acknowledge that a varying magnetic field in proximity with a plasma produces dramatic microwave absorption. More specifically, microwave absorption is enhanced when the varying magnetic field is produced near electron cycloton resonance.

The August reference discussed above teaches the use of a plasma to attenuate radar signals and suggests superimposing a DC magnetic field on the plasma as a means of enhancing attenuation. The Eldridge reference teaches using an ionized gas cloud to cloak an object, but fails to disclose or predict the use of a magnetic field with the ionized gas cloud to increase attenuation of the incident radar signals.

The Eubanks reference teaches the absorption of radar signals so as to reduce or negate any reflected signal, but this reference neither claims nor predicts the use of a dipolar magnetic field supplied with a weak plasma to absorb incoming radar signals. There are no plasmas in this reference.

The Marks reference is not concerned with the absorption of radar signals at all, but is a light-controlling device. There is no plasma present in this reference and a magnetic field, if present, is used for the sole purpose of controlling the orientation of dipolar particles in suspension.

While the above-cited references are instructive, there remains the need to provide a system capable of cloaking a target using a dipolar magnetic field supplied with a weak plasma to absorb probing radar signals. The present invention is intended to satisfy that need.

SUMMARY OF THE INVENTION

The present invention includes a method and apparatus for the plasma cloaking of military targets, such as space satellites or aircraft. This invention includes a superconducting magnetic coil, which will generate a dipole magnetic field, in a target. A weak plasma is supplied to this magnetic field; at orbital altitudes the field will fill up with plasma as does the earth's magnetosphere, but in the atmosphere a plasma generating means is needed. Incoming radar signals will then enter this plasma and be absorbed.

In an embodiment which has been demeonstrated in the inventor's laboratory, a modified Penning discharge system is used to generate plasma by ionizing helium using: two cathodes, a ring anode and an electrical power source. The two cathodes are on opposite sides of the helium with the ring anode in the middle such that they ionize the helium into the plasma. Note that in such Penning discharge systems, the electrons are forced to oscillate between the two opposed cathodes, and are prevented from going into the ring anode by the presence of a magnetic field. Accordingly, a plurality of magnetic coils surround the cathodes and generate a varying magnetic field with a mirror configuration. As mentioned above, when microwave signals enter the magnetized plasma, they are attenuated, particularly when they reach a magnetic induction which corresponds the electron cycloton resonance frequency.

In operation, the system described above provides a plasma cloaking means by which military targets could be made to disappear from radar screens by surrounding them with a suitable magnetized plasma. These targets include both endoatmospheric aircraft, and exoatmospheric satellites and spacecraft. However, it is important to note that the attenuation of microwave signals is a protective measure against directed energy weapons as well as an antidetection device. More specifically, there exist a category of weapons which directs a powerful electromagnetic pulse (EMP) to disrupt the computer, control and communication system of targets. The present invention provides a magnetized plasma which can attenuate the effects of such threats. In a test configuration, the system described above includes: a radio frequency (RF) transmitter; a transmitting waveguide which conducts the RF signal to radiate near one cathode; a collecting waveguide placed at the opposing cathode; a feed horn receiver which collects and measures the attenuated microwave signals; a computer and a network analyzer which records the attenuation as a measured function of frequency.

As described above, it is an object of the present invention to provide a plasma cloaking system which can hide satellites and aircraft from radar tracking systems.

It is another object of the invention to provide a microwave attenuation system which protects targets from directed energy weapons.

It is another object of the present invention to provide a general purpose microwave signal antidetection system.

These objects together with other objects, features and advantages of the invention will become more readily apparent from the following detailed description when taken in conjunction with the accompanying drawings wherein like elements are given like reference numerals throughout.

DESCRIPTION OF THE DRAWINGS

FIG. 2 is a chart of the axial profile of the number density at $V_A=1.5$ kV, $I_A=40$ mA, $P=100$ Torr, $B=0.255$ T, while FIG. 3 depicts the axial profile of the electron kinetic temperature at $V_A=1.5$ kV, $I_A=40$mA, $P=100$ Torr, $B=0.255$ T.

FIG. 7 is a chart of plasma attenuation, the upper curve is with the plasma off while the lower curve is with the plasma on;

DETAILED DESCRIPTION OF THE PREFERRED EMBODIMENT

Figure 1:
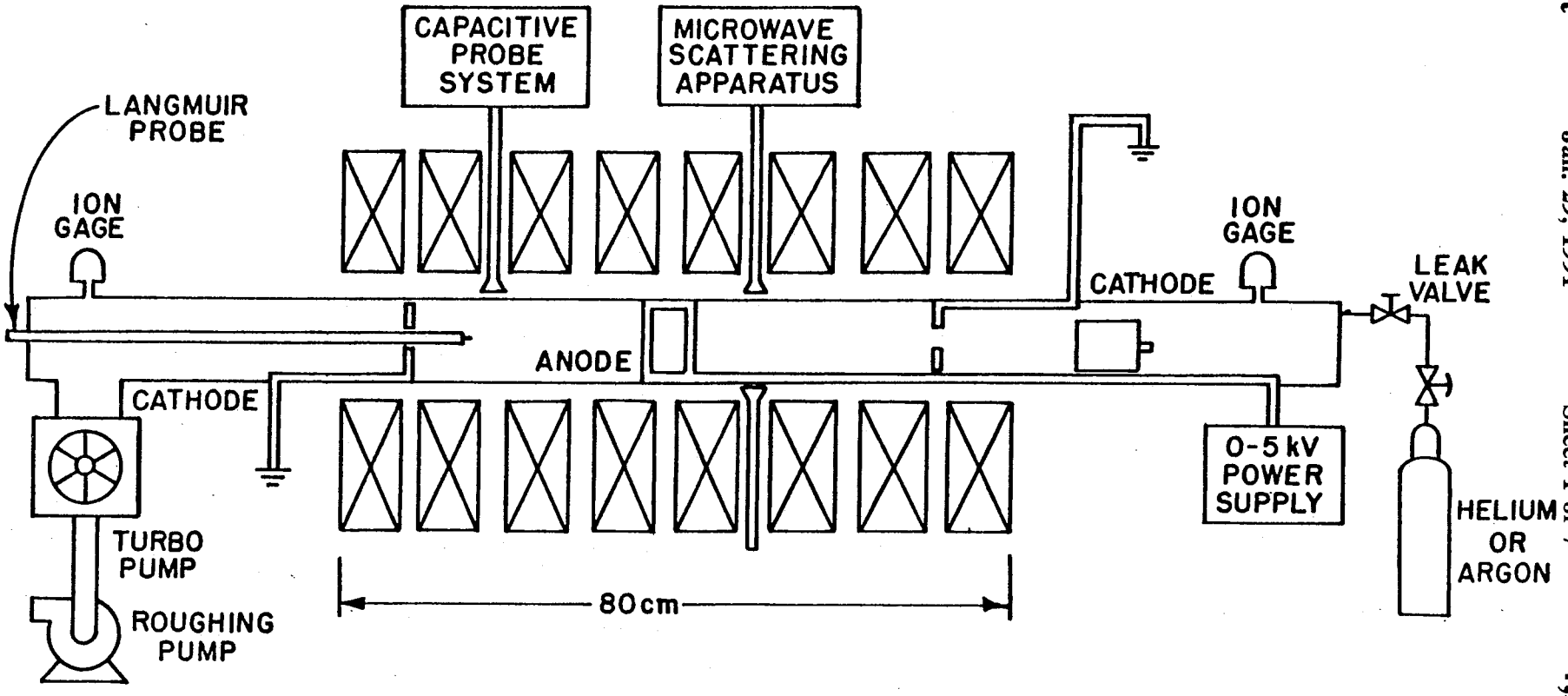
FIG. 1 is a schematic of a complete Penning discharge system.

The present invention includes a system which provides plasma protection by the interaction of electromagnetic radiation with magnetized plasma. The resulting absorption and attenuation of microwave signals allows the present invention to serve as a plasma cloaking device, or a protection system which attenuates the output signals of directed energy weapons.

Plasma cloaking can be effected by surrounding the object to be shielded with a plasma which is capable of either reflecting, scattering, or absorbing the incoming radiation. Approaches to plasma cloaking based on reflection and scattering must be handled with a great deal of caution lest the net effect be to increase the apparent size of the radar image of the object to be cloaked. It seems fairly clear that the safest of these three approaches is to absorb the radiation used to detect the target. A consideration of the basic principles of interaction of electromagnetic waves with plasmas indicates that it is relatively difficult to absorb microwave power in unmagnetized plasmas. Experience in the field of fusion research indicates that RF plasma heating (and therefore absorption) is most effectively done at three major frequencies; ion cyclotron resonance heating, lower hybrid heating, and electron cyclotron heating.

Ion and electron cyclotron heating are done at the gyro frequency of the ions or electrons, given by:

$$\omega = \frac{eB}{m} \tag{1}$$

These frequencies are a function only of the charge to mass ratio and the magnetic induction. At magnetic inductions likely to be encountered in plasma cloaking applications, the ion cyclotron frequency is likely to be too low to be of interest, in view of the normal operating frequencies of systems of interest. Microwave frequencies in the electromagnetic spectrum range between 300 Mc and 300 Gc. A subset of these frequencies of special interest include the VHF, UHF and HF radar frequencies listed below in Table 1:

TABLE 1

| Radar frequency band | Frequency |
|---|---|
| UHF . . . | 300–1,000 Mc |
| L . . . | 1,000–2,000 Mc |
| S . . . | 2,000–4,000 Mc |
| C . . . | 4,000–8,000 Mc |
| X . . . | 8,000–12,500 Mc |

TABLE 1-continued

| Radar frequency band | Frequency |
|---|---|
| K . . . | 12.5–18 Gc |
| K . . . | 18–26.5 Gc |
| K . . . | 26.5–40 Gc |
| Millimeter . . . | >40 Gc |

In magnetic inductions of a few tenths of a Tesla, the electronic cyclotron frequency is comparable to the frequencies used by many radar systems. The third possibility, absorbing rf power at the lower hybrid frequency, is not likely to be of interest for plasma cloaking applications. The lower hybrid frequency is electron number density dependent, and it could be very difficult, in operational terms, to match the plasma number density to frequency. Consideration of the Appleton equation, which describes the interaction of electromagnetic radiation with a magnetized plasma, indicates that significant absorption should occur in the vicinity of the electron cyclotron frequency. For magnetic inductions between 0.010 and 0.42 Tesla (typical of our experiment), the electron cyclotron frequency ranges from 1.76 gigahertz to 70 gigahertz, the range of interest for radar systems. Some experimental data generated on the absorption of 9.75 gigahertz radiation at the electron cyclotron frequency, obtained at the UTK Plasma Science Laboratory, will now be described.

FIG. 1 is a schematic of a Penning discharge system whose components are usable in this invention. The FIG. 1 system can generate a uniform axial magnetic field, which produced the data of FIG. 5 which will be discussed below. The Penning discharge is operated in the steady state, and at magnetic inductions that vary between 0.10 Tesla and 0.42 Tesla. Pertinent features of this discharge are that it is electric field dominated, with strong axial and radial electric fields, sometimes exceeding several hundred volts per centimeter, and it has high levels of plasma turbulence, maintained by the energy input from the applied electric fields. The ions and electrons are heated by E/B rotation, which gives rise to an ion population that is hotter than the electron population. This Penning discharge system was used in a plasma heating experiment involving collisional magnetic pumping, in which plasma heating from collisional magnetic pumping was demonstrated for the first time.

Figure 2:
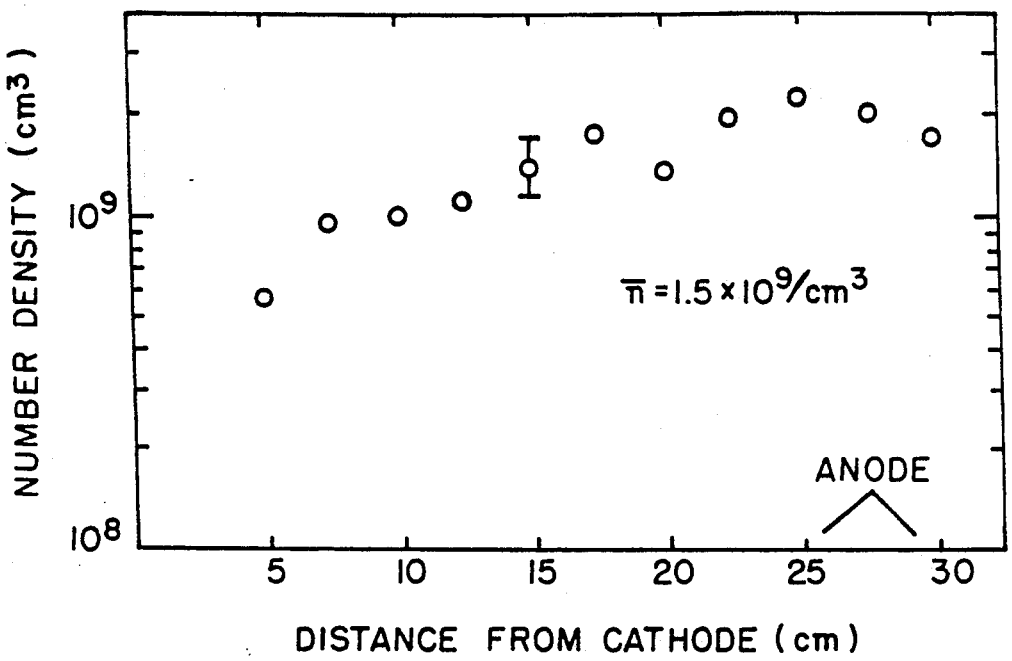
FIGS. 2 and 3 are charts of data produced by operation of the system of FIG. 1.
Figure 3:
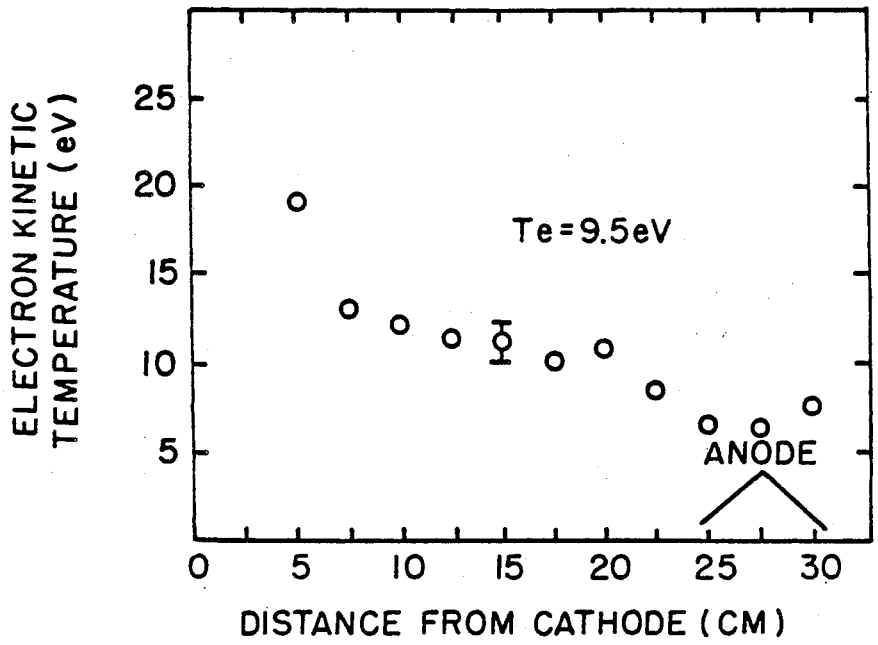

On FIGS. 2 and 3 are shown some characteristic data taken along the axis of the discharge. The electron number density was typically $10^9$ per cubic centimeter, and the electron temperature was about 10 eV. This classical Penning discharge was instrumented with a variety of diagnostics, including the axial Lagmuir probe that produced the data on FIGS. 2 and 3. Also included was the experimental setup shown on FIG. 4 in which a transmitting horn and a receiving horn were put on either side of the cylindrical plasma, and connected to a microwave network analyzer. This network analyzer makes it possible for us to irradiate the plasma with a microwave signal of variable frequency over the range from 0.2 to 18 gigahertz. After passing through the plasma, the signal is picked up by the receiving horn and analyzed by the network analyzer.

Figure 4:
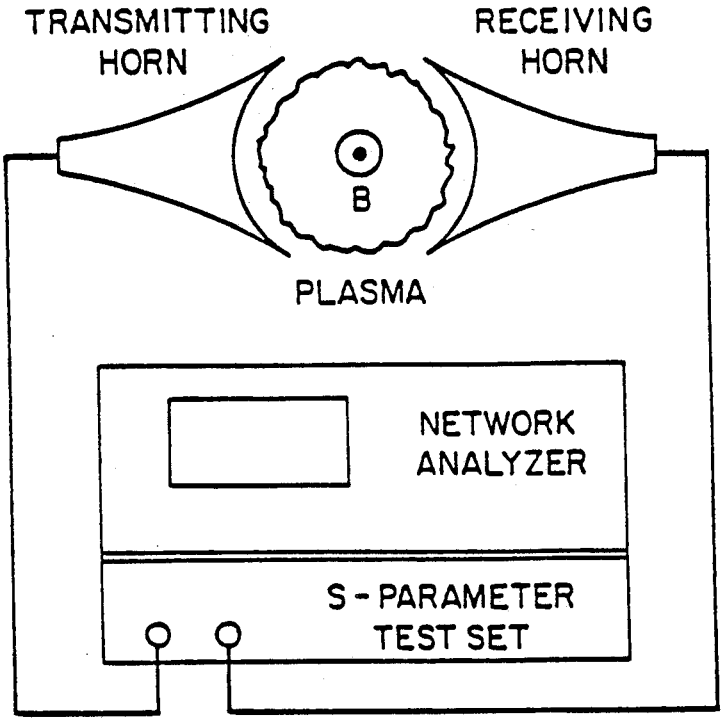
FIG. 4 is an illustration of the test configuration approach to the present invention to measure microwave attenuation produced by a varying magnetized plasma.

The purpose of the instrumentation shown in FIG. 4 was to implement a new diagnostic, intended to measure experimentally the effective electron collision frequency in the plasma. The dielectric constant of a plasma is given by the Appleton equation, below. This equation contains the electron cyclotron frequency $\omega_{cy}$, the electron plasma frequency $\omega_p$, and the collision frequency $\omega$. It can be shown that the full width of the absorption peak, at half-maximum amplitude at the electron cyclotron frequency is related to the effective electron collision frequency appearing in the Appleton equation. Thus, a measurement of the resonant absorption peak at the electron cyclotron frequency with the microwave network analyzer will allow a measurement of the effective collision frequency.

$$\epsilon(\omega) = \mu_{ex}^2 = 1 - \frac{\dfrac{\omega_p^2}{\omega^2}}{1 - j\dfrac{V_c}{\omega} - \dfrac{\omega_{cy}^2/\omega^2}{1 - \dfrac{\omega_p^2}{\omega^2} - j\dfrac{V_c}{\omega}}}, \tag{2}$$

where $$\alpha = \frac{\omega}{c} X \qquad \beta = \frac{\omega}{c} \mu$$

and $\omega_p$=plasma frequency, $\omega$=wave frequency, and v=collision frequency $\omega_{cy}$=the electron cyclotron frequency The parameters and are the wave propagation constants. Consideration of the Appleton equation indicates that significant absorption (several ten's of dB) should occur in the vicinity of the electron cyclotron frequency for plasmas of only moderate number densities ($10^8$ and $10^9$ electrons per cubic centimeter). For magnetic inductions between about 0.010 and 0.42 Tesla (typical of our experiments), the electron cyclotron frequency ranges from 0.28 gigahertz to 11.8 gigahertz, the range of interest for many radar systems.

Figure 5:
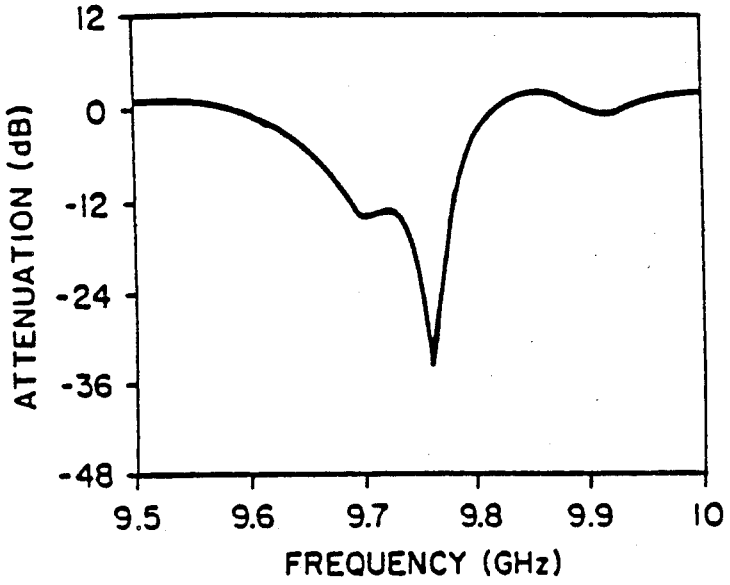
FIG. 5 is a chart of attenuation vs. Frequency.

Some characteristic data are shown on FIG. 5. Here, the electron cyclotron frequency was approximately 9.75 gigahertz. At this frequency, the absorption of the power was about 36 dB. The full width at half maximum of this curve yields an effective electron collision frequency of 7.5 megahertz, more than a factor 30 higher than the binary electron-neutral collision frequency shown in Table 2 below. The value of the effective collision frequency, and the fact that it is usually much higher than the binary collision frequency in this turbulent plasma, is of great interest.

TABLE 2

| COLLISION | COLLISION FREQUENCY, Hz |
|---|---|
| Electron-Neutral | $255.10^3$ |
| Ion-Neutral | $27.10^3$ |
| Electron-Electron | $1.9.10^3$ |
| Electron-Ion | 950 |
| Neutral-Neutral | 137 |
| Ion-Electron | 0.5 |
| Effective Collision Frequency (FIG. 6) | $7.5.10^6$ |

Figure 6:
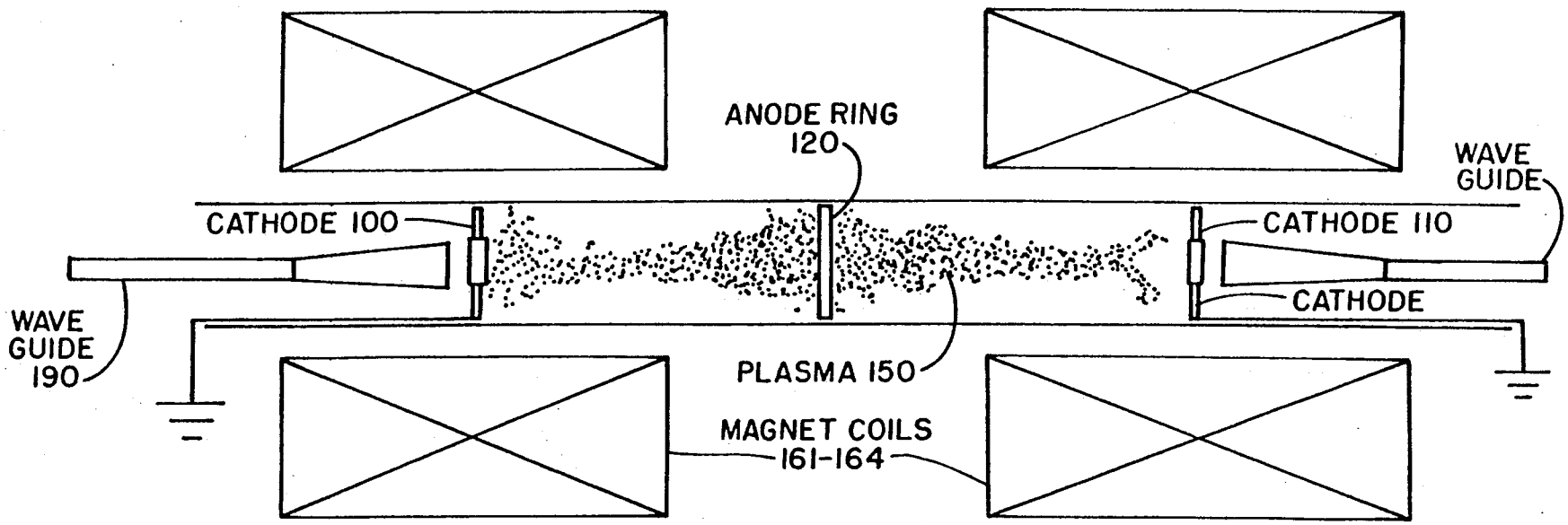
FIG. 6 is a schematic of an embodiment of the present invention.
Figure 7:
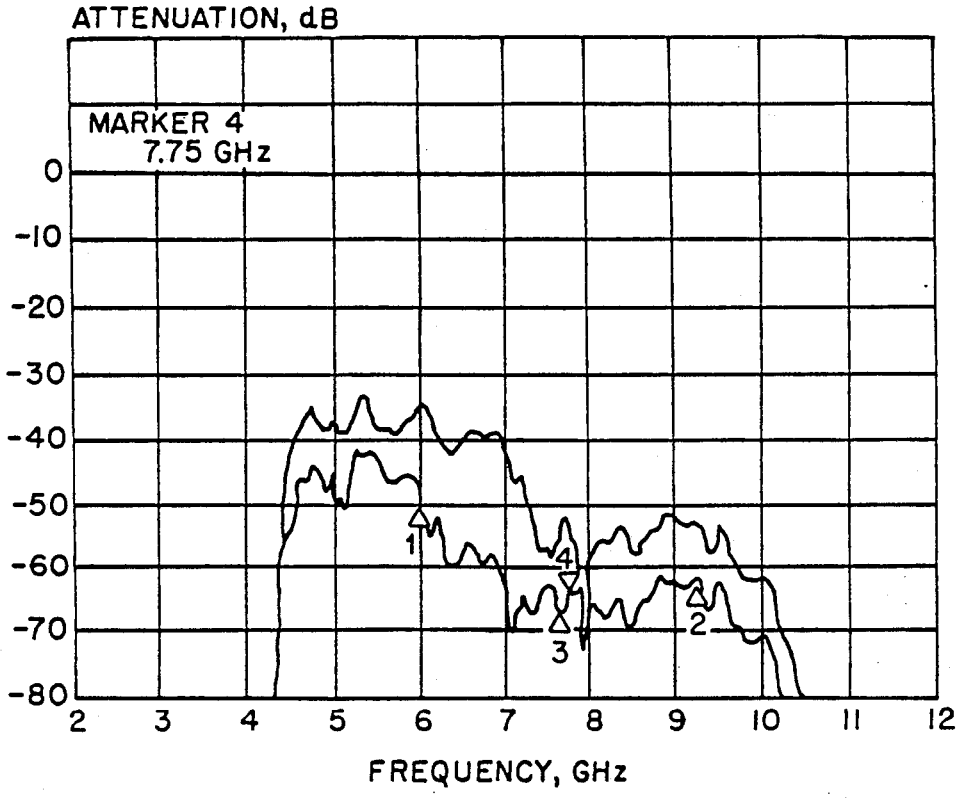

For the present discussion of plasma cloaking, the point of interest in FIG. 5 is the very large attenuation achieved in the vicinity of the electron cyclotron frequency, 36 dB in FIG. 5. This large attenuation was in no way unusual, and even higher attenuations were observed. The process occurring in the plasma are relatively complicated, and are not fully described by the Appleton equation, which is based on the cold plasma approximation. The minor peak in FIG. 6 to the left (lower frequency) of the electron cyclotron frequency represents a hot plasma effect. The fact that only a single such peak is seen, on one side of the electron cyclotron frequency, strongly indicates a nonlinear interaction. The general magnitude of the observed attenuation is consistent with the predictions of the Appleton equation, however, since this equation predicts attenuations that are typically 10's of dB for plasmas such as those in this classical Penning discharge. The average plasma density was approximately $1.5\times10^9$ particles per cubic centimeter. The plasma diameter was typically 12 or 15 centimeters, thus making the columnar density of the plasma no more than about $2\times10^{10}$ electrons per square centimeter. Thus, at the electron cyclotron frequency in a magnetized plasma, the electrons can very effectively absorb microwave power in the gigahertz range. FIG. 6 is an example of absorption at 9.75 gigahertz; in the experiments on the classical Penning discharge absorption was observed from approximately 5 Gigahertz up to about 15 Gigahertz during the course of these experiments.

It appears that very large attenuations of microwave power are possible in rarified plasmas and plasmas with relatively small columnar densities, provided only that they are in a magnetic field. The data referred to thus far and shown in FIG. 5 were taken for the extraordinary mode, in which the electric field vector of the wave is perpendicular to the magnetic field. Similarly large absorptions are not necessarily to be expected in the ordinary mode, with E parallel to B.

In exploiting the resonance at the electron cyclotron frequency as a cloaking mechanism, one probably should use a magnetic dipole as the magnetic containment configuration. If one were to have an earth satellite containing a large superconducting coil with generates a dipolar magnetic field, one may reasonably expect this dipole to accumulate from its surroundings at orbital altitudes, enough plasma to be useful for cloaking purposes, just as the earth's magnetic field accumulates particles in the magnetosphere. Electromagnetic radiation approaching such a plasma-charged dipole would first enter relatively weak magnetic fields with low electron cyclotron frequencies of a few megahertz, and would be absorbed by electron cyclotron resonance. In traveling toward the dipole, the electromagnetic radiation would progressively go through magnetic fields corresponding to electron cyclotron resonance at higher and higher frequencies until, before it reached the surface of the spacecraft, the radiation traveled through a magnetic field sufficiently strong that it was above all expected radar frequencies. Any radiation in the ordinary mode which is not absorbed by its passage through the plasma would be scattered or reflected by the interaction with the complicated dipolar magnetic field.

The implementation of this plasma cloaking concept aboard aircraft and in the atmosphere might be considerably more difficult, because of the necessity of generating a plasma in the dipolar magnetic field to absorb the incoming radiation.

Returning to FIG. 5, note that microwave absorption at the electron cyclotron resonance frequency in plasma was measured in the modified Penning discharge with uniform configuration. The measurement was taken by a model 8510 Hewlett Packard network analyzer which is capable of swept frequency from 0.045 to 18 GHz with 80 dB dynamic range.

The reader's attention is now directed towards FIG. 6 which is a schematic which presents a plan view of a modified Penning discharge system of the present invention. The system of FIG. 6 generates a plasma 150 by ionizing helium or argon into a plasma using two opposed cathodes 100, 110 with an anode ring fixed between 21em. A typical anode voltage would be 1,400 volts with a current of 50–500 mA. In one experiment, helium was used with a pressure of $1.1\times10^{-3}$ Torr, but these parameters will be varied depending upon the application of the invention. The magnetic field was varied between 0.167 and 0.261 Tesla, but this parameter can also be varied.

In FIG. 6, a waveguide 190 is shown to conduct a microwave signal into the magnetized plasma. This waveguide 190 is depicted because it is part of a test system which can be used to test the effectiveness of the invention in damping and absorbing microwave signals.

The modified Penning discharge used for generating plasma consists of a magnetic field with a mirror configuration. The mirror ratio is 1.6 ($B_{max}/B_{min}=1.6$). A steady-state plasma is generated between two cathodes where the magnetic field is a maximum. The density used was a few times $10^9/cm^3$, with electron temperature about 10 eV. A microwave beam is caused to propagate along the axis of a magnetic mirror field in the plasma column. Two radiation antennas (horns) were mounted behind the cathodes. A microwave beam propagates through an aperture at the center of each cathode and is received at the other end. The measurement of transmission and reflection coefficients from 2 GHz to 12 GHz were taken with the network analyzer. The system was normalized so that the normalized attenuation and absolute attenuation of microwave absorption in the plasma were measured by the network analyzer.

Multiple runs of the test were made of the configuration show on FIG. 6 under the conditions described below in Table 3.

TABLE 3

| OPERATING CONDITIONS | |
|---|---|
| Run A | |
| B field (max) | 0.261 Tesla |
| B field (min) | 0.167 Tesla |
| 1. Anode Voltage | 1400 Volts |
| Anode Current | 50 mA |
| HePressure | $1.1\times10^{-3}$ Torr |
| 2. Anode Voltage | 1550 volts |
| Anode Current | 90 mA |
| HePressure | $1.1\times10^{-3}$ Torr |
| 3. Anode Voltage | 1400 volts |
| Anode Current | 280 mA |
| HePressure | $1.8\times10^{-3}$ Torr |
| Run B | |
| B field (max) | 0.084 Tesla |
| B field (min) | 0.182 Tesla |
| 1. Anode Voltage | 1500 volts |
| Anode Current | 50 mA |
| HePressure | $1.1\times10^{-3}$ Torr |
| 2. Anode Voltage | 1600 volts |
| Anode Current | 90 mA |
| HePressure | $1.1\times10^{-3}$ Torr |
| 3. Anode Voltage | 1700 volts |
| Anode Current | 150 mA |
| HePressure | $1.1\times10^{-3}$ Torr |
| 4. Anode Voltage | 2000 volts |
| Anode Current | 270 mA |
| HePressure | $1.5\times10^{-3}$ Torr |
| 5. Anode Voltage | 2000 volts |
| Anode Current | 340 mA |
| HePressure | $1.7\times10^{-3}$ Torr |

TABLE 3-continued

| OPERATING CONDITIONS | |
|---|---|
| 6. Anode Voltage | 1400 volts |
| Anode Current | 350 mA |
| HePressure | $1.8 \times 10^{-3}$ Torr |
| Run C | |
| B field (max) | 0.329 Tesla |
| B field (min) | 0.212 Tesla |
| 1. Anode Voltage | 1400 volts |
| Anode Current | 350 mA |
| HePressure | $1.8 \times 10^{-3}$ Torr |

Some characteristic data are shown on FIG. 5. Here, the electron cyclotron frequency was approximately 9.75 gigahertz. At this frequency, the absorption of the power was about 36 dB. For the present discussion of plasma cloaking, the point of interest in FIG. 5 is the very large attenuation achieved in the vicinity of the electron cyclotron frequency, 36 dB. This large attenuation was in no way unusual, and even higher attenuations were sometimes observed. The general magnitude of the observed attenuation is consistent with the predictions of the Appleton equation, since it predicts attenuations that are typically 10's of dB for plasmas such as those in this classical Penning discharge. The average plasma density was approximately $1.5 \times 10^9$ particles per cubic centimeter. The plasma diameter was typically 12 or 15 centimeters, thus making the columnar density of the plasma no more than about $2 \times 10^{10}$ electrons per square centimeter. Thus, at the electron cyclotron frequency in a magnetized plasma, the electrons can very effectively absorb microwave power in the gigahertz range. FIG. 5 is an example of absorption at 9.75 gigahertz. In the experiments on the classical Penning discharge, absorption was observed from approximately 5 gigahertz up to about 15 gigahertz during the course of these experiments.

It appears that very large attenuations of microwave power are possible in rarified plasmas and plasmas with relatively small columnar densities, provided only that they are in a varying magnetic field. The data referred to thus far and shown in FIG. 5 were taken for the extraordinary mode, in which the electric field vector of the wave is perpendicular to the magnetic field. Similarly large absorptions are not necessarily to be expected in the ordinary mode, with E parallel to B.

More data was taken using the system of FIG. 6, which is a modified Penning discharge with a magnetic mirror configuration having a ratio of maximum to minimum magnetic field of 1.6 to 1 along the axis. The geometry is shown schematically in FIG. 6, the cathodes of the Penning discharge were located at the magnetic field maximum, and immediately behind each was located a microwave horn which was screened from the plasma by horizontal grid wires aligned parallel to the electric field of the microwave radiation. This allowed microwave radiation from approximately 4 to 10 gigahertz to propagate along this magnetized plasma, with a magnetic field variation of at least 1.6 to 1 along the path of microwave propagation. The microwave horns were hooked up to our Hewlett Packard Model 8510 microwave network analyzer, which was swept over frequencies from 2 to 12 gigahertz. It was expected that attempting to propagate the microwave signal through a plasma embedded in a variable magnetic field would greatly broaden the bandwidth over which electron cyclotron resonance absorption occurred. This expectation was observed.

Figure 8:
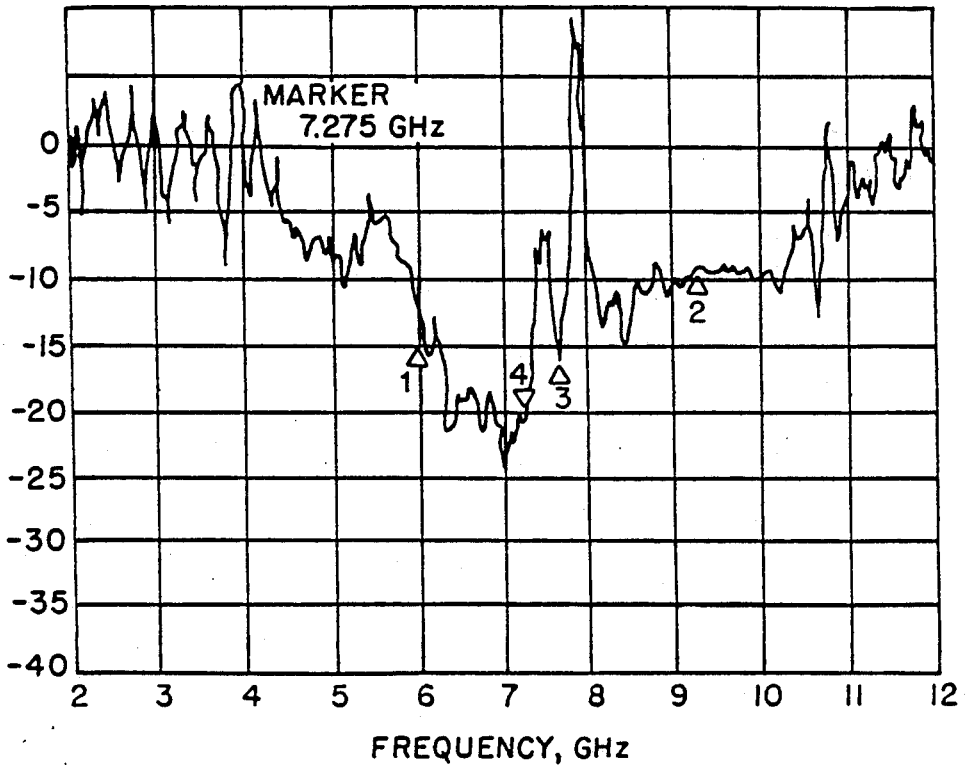
FIG. 8 is a chart of normalized plasma accentuation.

On FIG. 8 is shown the absolute attenuation of the microwave signal from approximately 4.3 GHz to 10.5 GHz. Beyond these frequency limits, the microwave waveguide and other circuit components cut off. The upper curve is the attenuation of the system with the plasma off. The lower curve shows the transmission through the system with the plasma on. In this case, there is up to approximately 20 dB of attenuation at frequencies which have an ion cyclotron resonance in the plasma volume.

Figure 9:
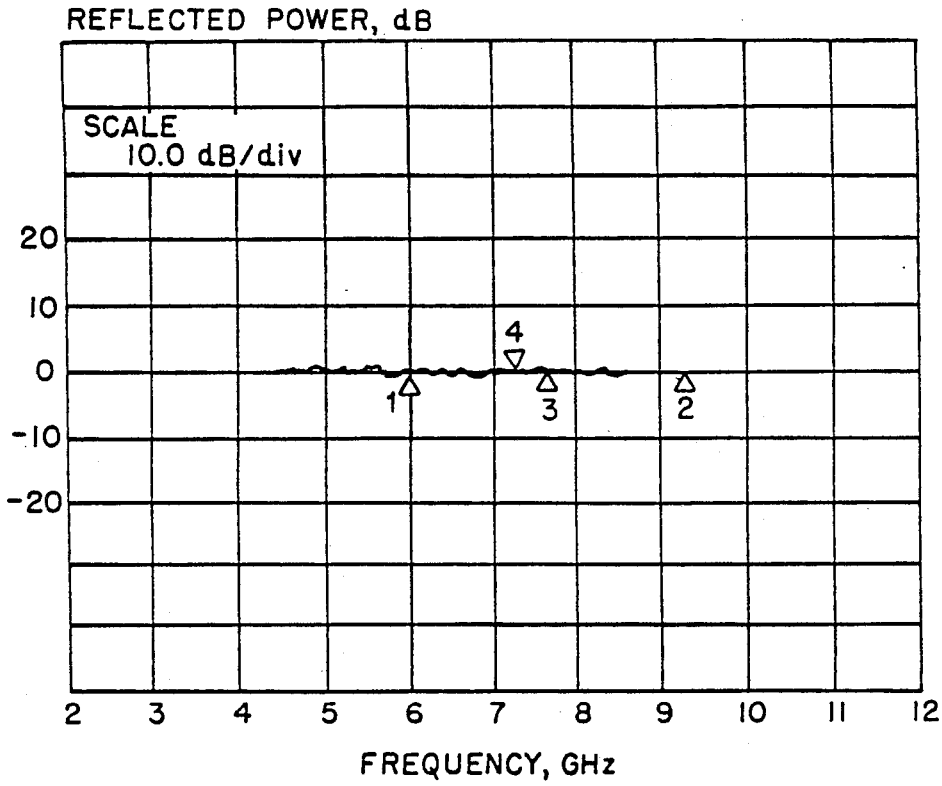
FIG. 9 is a chart of normalized plasma reflection.
Figure 10:
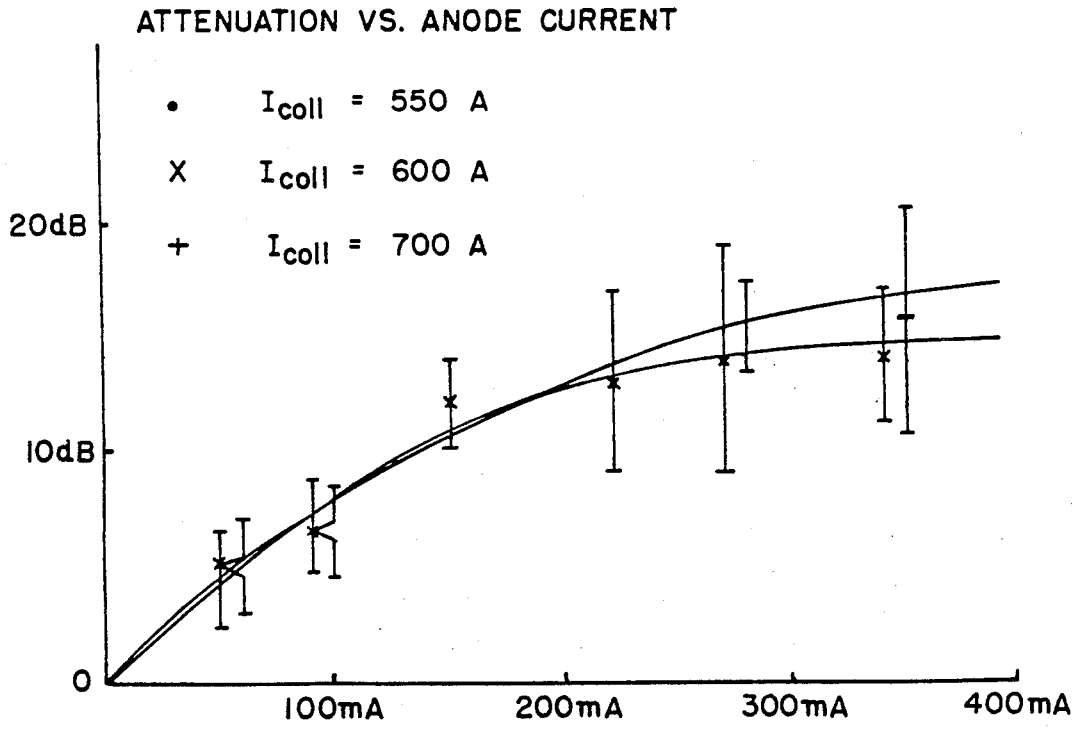
FIG. 10 is a chart of attenuation vs. anode current.

The normalized attenuation is shown on FIG. 8, which shows the attenuation curve normalized to the signal received without the plasma. Here the attenuation is at least 5 dB over the entire range, and a maximum of more than 20 dB. Markers No. 2 and 1 on this plot indicate, respectively, the electron cyclotron resonance frequencies corresponding to the maximum and minimum of the magnetic induction in the plasma volume. It is interesting to note that significant attenuation occurs even at frequencies for which there is no electron cyclotron resonance in the plasma containment volume. FIG. 9 shows the normalized reflection of microwave signal from the plasma. In all cases, including this one, the reflected signal was within the noise limits of the system, and no more than one or two dB. These data are very encouraging indication that magnetized plasmas can not only absorb, but also not reflect any significant signal when the incoming radiation is in the extraordinary mode, and in electron cyclotron resonance. Finally, FIG. 10 shows the attenuation in dB as a function of the Penning anode current, which is proportional to the electron number density in the plasma. This shows a monotone increase of attenuation with electron number density, a dependence which is to be expected on the basis of the Appleton equation and elementary physical consideration.

Tests on the present invention have indicated that magnetized plasmas could absorb several tens of dB of incoming microwave energy in the extraordinary mode, using relatively low density plasmas (no more than $10^8$ to $10^9$ per cubic centimeter) and at frequencies ranging from 2 to 12 gigahertz, which spans the range used by many military radar systems.

Many variations of the present invention as generally described above are possible. For example, the plasma cloaking system can use a superconducting coil, which would generate a dipole magnetic field, in a target such as an aircraft or a space satellite. The dipolar magnetic field could be supplied with a weak plasma to form a "magnetosphere" surrounding the target. In this system, probing radar signals of a wide range of frequencies would enter this artificial magnetosphere surrounding the target, and be absorbed when they reached a magnetic induction corresponding to the electron cyclotron frequency.

Figure 11:
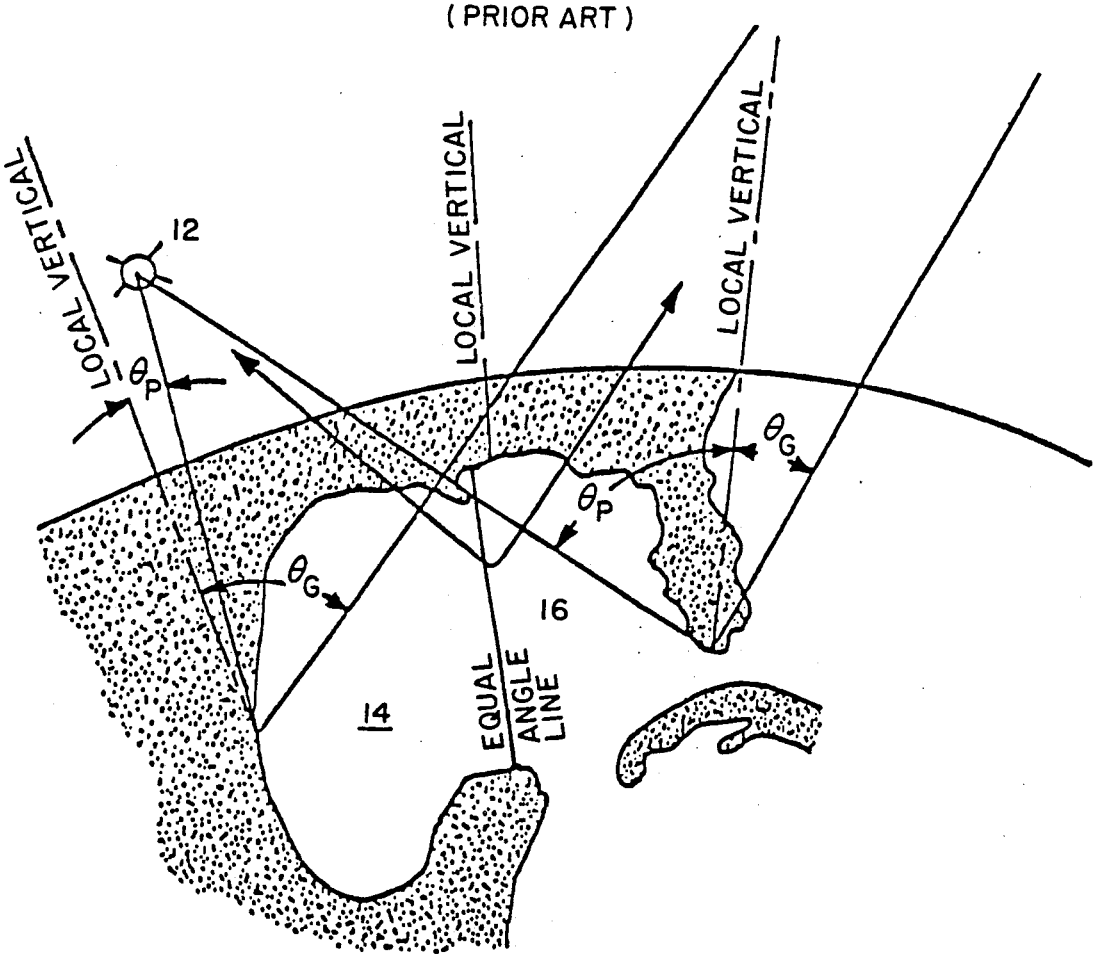
FIG. 11 (PRIOR ART)
FIGS. 11 and 12 are illustrations of two potential radar targets that can use the present invention as a plasma cloaking system.
Figure 12:
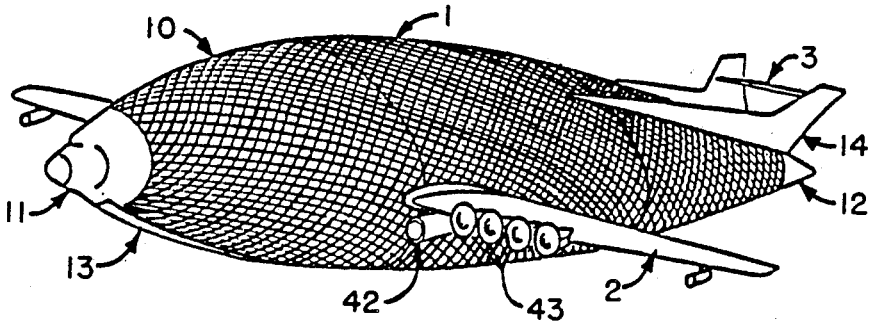
FIG. 12 (PRIOR ART)

FIGS. 11 and 12 are illustrations of potential radar targets that may use the present invention as a plasma cloaking device. FIG. 11 is an illustration of a satellite 12 that is being tracked by multiple ground-based radar systems. When this satellite 12 is equipped with a superconducting coil, a dipole magnetic field will surround the satellite. In orbital attitudes, the dipolar field will fill up with plasma, much as the earth's magnetosphere does from its surroundings. When the coil introduces a varying magnetic field in this plasma, it will attenuate the radar signals as described above.

Endoatmospheric aircraft will be difficult to surround with plasma since their forward velocity may allow the wind to strip away the plasma cloud around the craft. FIG. 12 is an illustration of an aircraft taken from U.S. Pat. No. 4,052,025, which is incorporated by reference, and which shows an aircraft encompassed by a buoyant envelope. When the gas inside the envelope is ionized He, the present invention can be used to cloak the aircraft without the danger of the plasma cloud being left behind. Alternative to this approach include the generation of a steady released flow of ionized gas around the aircraft which is replenished as it is left behind.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A microwave absorption system which protects a target from microwaveelectromagnetic radiation, said microwave absorption system comprising:

a means of producing a plasma which will circumscribe said target; and a means for generating a varying magnetic field in said plasma to produce thereby a varying magnetized plasma which interacts with said microwave electromagnetic radiation to absorb and attenuate it before it reaches said target; where said generating means comprises a plurality of magnetic coils which are fixed in proximity with said producing means, and which collectively output said varying magnetic field with a variation factor in magnetic induction, said variation factor being a ratio of a maximum of said varying magnetic field in Tesla, divided by a minimum of said varying magnetic field in Tesla, as produced by said plurality of magnetic coils.

2. A microwave absorption system which protects a target from microwave electromagnetic radiation, said microwave absorption system comprising:

a source of gas which may be converted into plasma when subjected to an electric arc, said source of gas outputting a gas cloud in proximity with said target;

a means for generating a varying magnetic field in said plasma to produce thereby a varying magnetized plasma which interacts with said microwave electromagnetic radiation to absorb and attenuate it before it reaches said target;

first and second cathodes which are fixed on opposite sides of said gas cloud; and a ring anode which is fixed between said first and second cathodes to conduct said electric arc therebetween and produce thereby said plasma so that it may be magnetized by said generating means with said varying magnetic field and absorb said microwave electromagnetic radiation before it reaches said target.

3. A microwave absorption system which protects a target from microwave electromagnetic radiation, said microwave absorption system comprising;

a means of producing a plasma which will circumscribe said target; and a means for generating a varying magnetic field in said plasma to produce thereby a varying magnetized plasma which interacts with said microwave electromagnetic radiation to absorb and attenuate it before it reaches said target, wherein said microwave electromagnetic radiation comprises transmitted radar signals which have a radar frequency that ranges between 300 megahertz and 300 gigahertz, and wherein said generating means generates said varying magnetic field with a plasma frequency which has a value near that of said radar frequency in order to enhance absorption and attenuation of said microwave electromagnetic radiation as it interacts with said varying magnetized plasma.

4. A microwave absorption which protects a target from microwave electromagnetic radiation, said microwave absorption system comprising:

a means of producing a plasma which will circumscribe said target; and a means for generating a varying magnetic field in said plasma to produce thereby a varying magnetized plasma which interacts with said microwave electromagnetic radiation to absorb and attenuate it before it reaches said target, wherein said microwave electromagnetic radiation comprises an electromagnetic pulse signal directed at said target by a directed energy weapon with a pulse frequency that ranges between 300 megahertz and 300 gigahertz, and wherein said generating means generates said varying magnetic field with a plasma frequency which has a value near that of said pulse frequency in order to enhance absorption and attenuation of said microwave electromagnetic radiation as it interacts with said varying magnetized plasma.

5. A microwave absorption system, as defined in claim 1, wherein said producing means comprises:

a source of gas which may be converted into plasma when subjected to an electric arc, said source of gas outputting a gas cloud in proximity with said target;

first and second cathodes which are fixed on opposite sides of said gas cloud; and a ring anode which is fixed between said first and second cathodes to conduct said electric arc therebetween and produce thereby said plasma so that it may be magnetized by said generating means with said varying magnetic field and absorb said microwave electromagnetic radiation before it reaches said target.

6. A microwave absorption system, as defined in claim 1, wherein said microwave electromagnetic radiation comprises transmitted radar signals which have a radar frequency that ranges between 300 megahertz and 300 gigahertz, and wherein said generating means generates said varying magnetic field with a plasma frequency which has a value near that of said radar frequency in order to enhance absorption and attenuation of said microwave electromagnetic radiation as it interacts with said varying magnetized plasma.

7. A microwave absorption system, as defined in claim 2, wherein said microwave electromagnetic radiation comprises transmitted radar signals which have a radar frequency that ranges between 300 megahertz and 300 gigahertz, and wherein said generating means generates said varying magnetic field with a plasma frequency which has a value near that of said radar frequency in order to enhance absorption and attenuation of said microwave electromagnetic radiation as it interacts with said varying magnetized plasma.

8. A microwave absorption system, as defined in claim 1, wherein said microwave electromagnetic radiation comprises an electromagnetic pulse signal directed at said target by a directed energy weapon with a pulse frequency that ranges between 300 megahertz and 300 gigahertz, and wherein said generating means generates said varying magnetic field with a plasma frequency which has a value near that of said pulse frequency in order to enhance absorption and attenuation of said microwave electromagnetic radiation as it interacts with said varying magnetized plasma.

9. A microwave absorption system, as defined in claim 2, wherein said microwave electromagnetic radiation comprises an electromagnetic pulse signal directed at said target by a directed energy weapon with a pulse frequency that ranges between 300 megahertz and 300 gigahertz, and wherein said generating means generates said varying magnetic field with a plasma frequency which has a value near that of said pulse frequency in order to enhance absorption and attenuation of said microwave electromagnetic radiation as it interacts with said varying magnetized plasma.

10. A plasma cloaking system which protects targets from being detected by radar systems that emit microwave electromagnetic radiation, said plasma cloaking system comprising:

a means for producing a plasma which will circumscribe said target; and a means for generating a varying magnetic field in said plasma to produce thereby a varying magnetized plasma which interacts with said microwave electromagnetic radiation to absorb and attenuate it before it reaches said target; wherein said generating means comprises a plurality of magnetic coils which are fixed in proximity with said producing means, and which collectively output said varying magnetic field with a variation factor in magnetic induction, said variation factor being a ratio of a maximum of said varying magnetic field in Tesla, divided by a minimum of said varying field in Tesla, as produced by said plurality of magnetic coils.

11. A plasma cloaking system which protects targets from being detected by radar systems that emit microwave electromagnetic radiation, said plasma cloaking system comprising:

a source of gas which may be converted into plasma when subjected to an electric arc, said source of gas outputting a gas cloud in proximity with said target;

a means for generating a varying magnetic field in said plasma to produce thereby a varying magnetized plasma which interacts with said microwave electromagnetic radiation to absorb and attenuate it before it reaches said target;

first and second cathodes which are fixed on opposite sides of said gas cloud; and a ring anode which is fixed between said first and second cathodes to conduct said electric arc therebetween and produce thereby said plasma so that it may be magnetized by said generating means with said varying magnetic field and absorb said microwave electromagnetic radiation before it reaches said target.

12. A plasma cloaking system which protects targets from being detected by radar systems that emit microwave electromagnetic radiation, said plasma cloaking system comprising:

a means for producing a plasma which will circumscribe said target; and a means for generating a varying magnetic field in said plasma to produce thereby a varying magnetized plasma which interacts with said microwave electromagnetic radiation to absorb and attenuate it before it reaches said target, wherein said microwave electromagnetic radiation comprises transmitted rear signals which have a radar frequency, and wherein said generating means generates said varying magnetic field with a plasma frequency which has a value near that of said radar frequency in order to enhance absorption and attenuation of said microwave electromagnetic radiation as it interacts with said varying magnetized plasma.

13. A microwave absorption system, as defined in claim 10, wherein said microwave electromagnetic radiation comprises transmitted radar signals which have a radar frequency, and wherein said generating means generates said varying magnetic field with a plasma frequency which has a value near that of said radar frequency in order to enhance absorption and attenuation of said microwave electromagnetic radiation as it interacts with said varying magnetized plasma.

14. A microwave absorption system, as defined in claim 13, wherein said microwave electromagnetic radiation comprises transmitted radar signals which have a radar frequency, and wherein said generating means generates said varying magnetic field with a plasma frequency which has a value near that of said radar frequency in order to enhance absorption and attenuation of said microwave electromagnetic radiation as it interacts with said varying magnetized plasma.

* * * * *